US007083314B2

(12) United States Patent
Chen

(10) Patent No.: US 7,083,314 B2
(45) Date of Patent: Aug. 1, 2006

(54) SUSPENSIBLE NIGHT-LUMINOUS DECORATION

(75) Inventor: Wei-Che Chen, Tainan (TW)

(73) Assignee: Kuen-Ting Shih, Yung-Kang (TW)

( * ) Notice: Subject to any disclaimer, the term of this patent is extended or adjusted under 35 U.S.C. 154(b) by 1 day.

(21) Appl. No.: 11/003,356

(22) Filed: Dec. 6, 2004

(65) Prior Publication Data

US 2006/0120076 A1 Jun. 8, 2006

(51) Int. Cl.
*F21V 21/00* (2006.01)

(52) U.S. Cl. ..... 362/555; 362/806; 362/800; 362/565; 362/231; 362/235; 362/311; 362/326; 362/443

(58) Field of Classification Search ..... 362/555, 362/570, 571, 565, 800, 644, 235, 231, 249, 362/311, 326, 443, 806

See application file for complete search history.

(56) References Cited

U.S. PATENT DOCUMENTS 3,253,137 A * 5/1966 Richter, III ..... 362/293
5,772,312 A * 6/1998 Pihl-Niederman et al. .. 362/249
2003/0223238 A1* 12/2003 Hsu et al. ..... 362/255

* cited by examiner

*Primary Examiner*—Sandra O'Shea
*Assistant Examiner*—Sharon Payne

(57) ABSTRACT

A suspensible night-luminous decoration includes a suspending member, a light unit and a transparent decorative body. The suspensible member consists of a hook and a connect tube under the hook, and the connect tube contains the LED of the light unit having a circuit board and plural LED. The decorative body has a connective head and a swelled portion under the connective head. The swelled portion contains many transparent air bubbles and the connective head has a light groove for the LED to extend in, and the bottom of the light groove is located just on top of the swelled portion. When the LED are lit up, their different colored light beams shoot through the swelled portion so that the air bubbles may reflect different colored lights to make the suspensible night-luminous decoration provided with effect of alteration of different colored lights.

3 Claims, 4 Drawing Sheets

SUSPENSIBLE NIGHT-LUMINOUS DECORATION

BACKGROUND OF THE INVENTION

1. Field of the Invention

This invention relates to a suspensible night-luminous decoration, particularly to one possible to change alternately different colored lights for shining a decorative body during nighttime.

2. Description of the Prior Art

Conventional suspensible decorations used for Christmas trees or the like generally have a decorative body connected with a string, and the string suspends the decoration. But conventional decorations do not have lights to be lit up during nighttime, so if they are to be shown brightly during nighttime, the decorations have the surface to be treated with fluorescent agent to let them produce dim light in one way, or a stringed small lights are arranged on the Christmas trees, intertwined with the suspensible decorations on the Christmas trees for letting the small colored lights flash. But the former can have only one single color for the fluorescent light, quite monotonous, and fluorescent agent may have negative influence for human health. The former can only produce flashing of the small colored lights, not giving so special visual impression, in addition to the lights small and of low heat-enduring, having short life span, and liable to get disorder.

SUMMARY OF THE INVENTION

The purpose of the invention is to offer a suspensible night-luminous decoration with function of alteration of different colored lights.

The feature of the invention is a suspensible member, a light unit and a decorative body, the suspensible member provided with a hook and a connect tube under the hook, the light unit provided with a circuit board and plural LED (light emitting diodes), the decorative body provided with a connective head and a swelled portion. The LED are contained in the connect tube, and the connective head is also fitted in the connect tube. When the LED are lit up, their light beams shoot through the decorative body and reflected by many air bubbles contained in the swelled portion to enable the suspensible night-luminous decoration to shine with different colored lights during nighttime.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
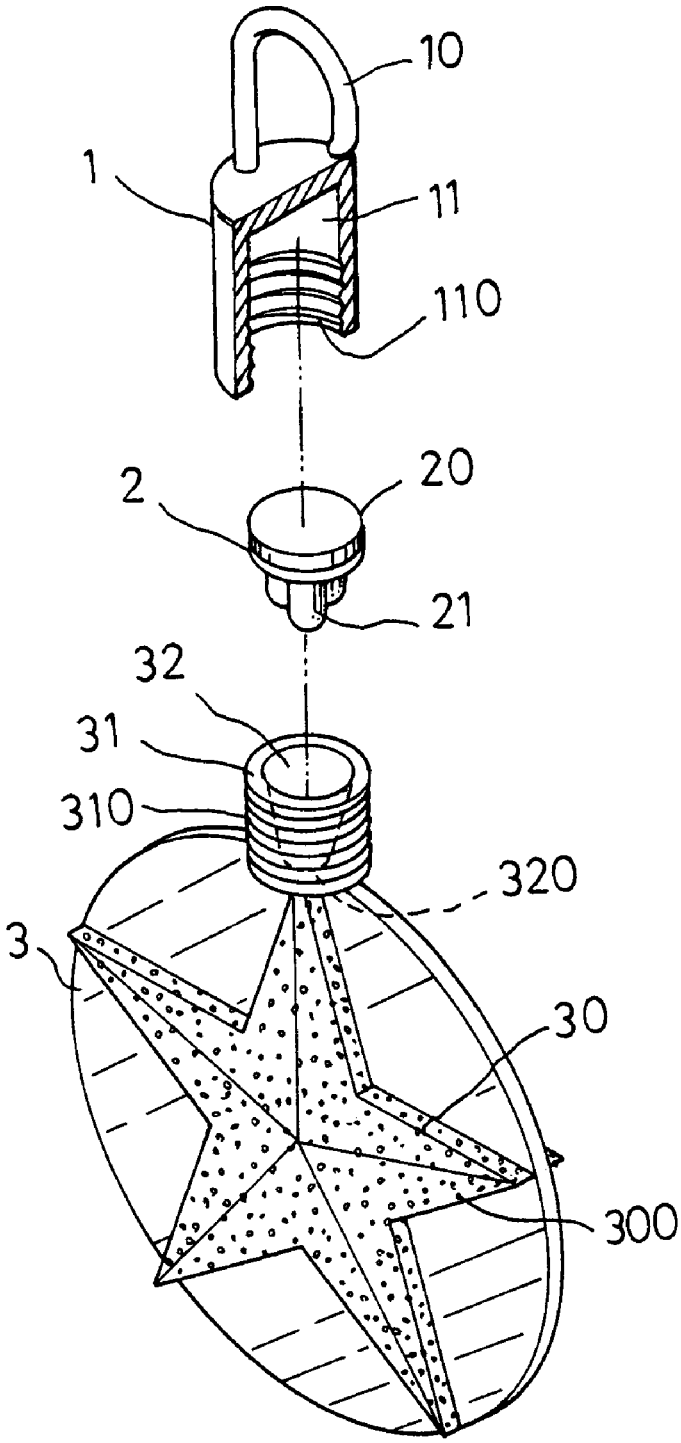
FIG. 1 is an exploded perspective view of a suspensible night-luminous decoration in the present invention.
Figure 2:
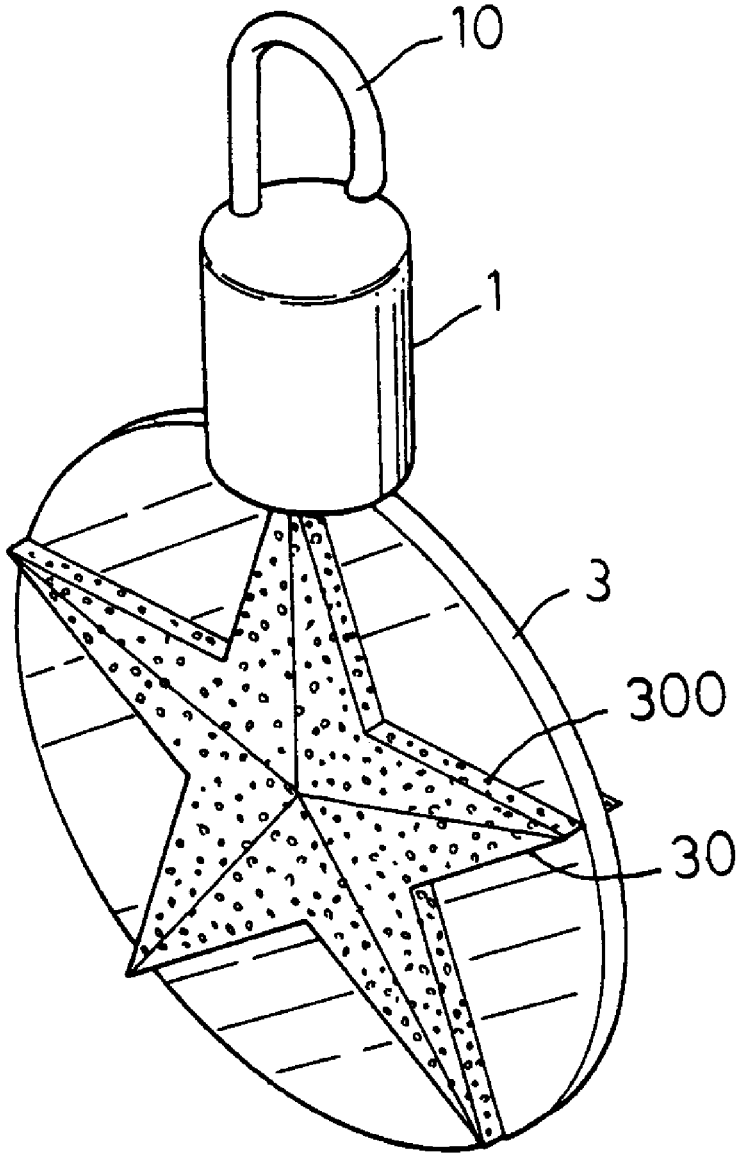
FIG. 2 is a perspective view of the suspensible night-luminous decoration in the present invention.
Figure 3:
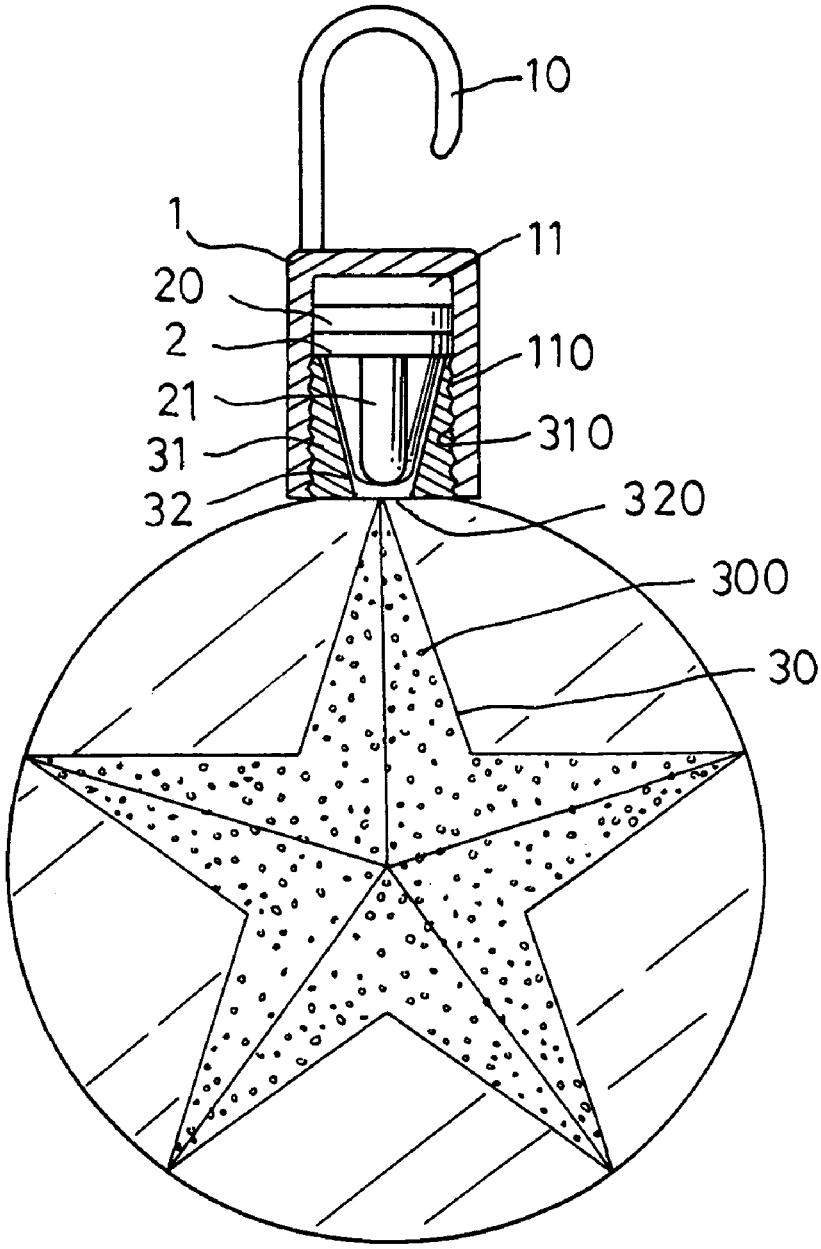
FIG. 3 is a cross-sectional view of the suspensible night-luminous decorations in the present invention.
Figure 4:
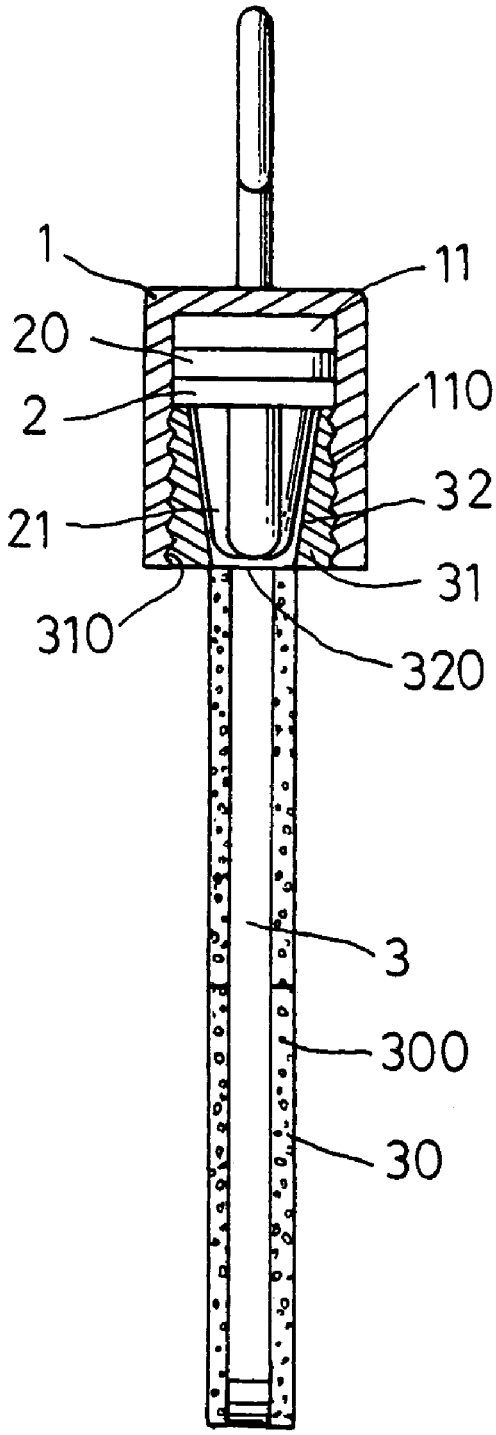
FIG. 4 is a side cross-sectional view of the suspensible night-luminous decoration in the present invention.

A preferred embodiment of a suspensible night-luminous decoration in the present invention, as shown in FIGS. 1 and 3, includes a suspending member 1, a light unit 2 and a decorative body 3 as main components.

The suspending member 1 has a hook 10 in an upper end, a connect tube 11 under the hook 10 and provided with female threads 110.

The light unit 2 is combined with the connect tube 11, having a circuit board 20, plural LEM (light emitting diodes) 21 under the circuit board 20 and electrically connected for emitting different colored lights.

The decorative body 3 is combined with the suspending member 1 for being suspended on something, made of a transparent material, having a swelled portion 30 with its surface printed with a pattern, and many transparent air bubbles contained in the swelled portion 30, and a connective head 31 fixed on the decorative body 3 and having male threads 310 on its outer surface to engage the female threads 110 to combine the decorative body 3 with the suspending member 1. Further, the connective head 31 has an inner cone-shaped groove 32 for receiving the LED 21 therein, and a groove bottom 320 formed at the bottom of the light groove 32, which is just located on top of the swelled portion 30.

In assembling, referring to FIGS. 1, 2, 3 and 4, the light unit 2 is combined with the upper end of the decorative body 3, with the LED 21 contained in the light groove 32 of the decorative body 3. Then the decorative body 3 is threadably combined with the suspending member 1 by engaging the male threads 310 with the female threads 110 of the connect tube 11, letting the LED 21 of the light 2 located almost near the groove bottom 320 of the light groove 32, finishing the assembly of the suspensible night-luminous decoration.

When the light unit 2 is lit up, the cone-shaped light groove 32 may focus the light beam of the LED 21 and shoot through the transparent decorative body 3 and shine the swelled portion with different colors changed alternately so that the air bubbles 300 in the swelled portion 30 may reflect different color lights through deflecting to let the whole decorative body 3 shown vividly. Further, different colored LED offers alteration of different colored lights for increasing visual aesthetic impression during nighttime.

While the preferred embodiment of the invention has been described above, it will be recognized and understood that various modifications may be made therein and the appended claims are intended to cover all such modifications that may fall within the spirit and scope of the invention.

What is claimed is:

1. A suspensible night-luminous decorations comprising:

a suspending member having a hook in an upper portion and a connect tube fixed under said hook;

a light unit contained in said connect tube of said suspending member and having a circuit board and plural LEDs electrically connected with said circuit board;

a decorative body combined with said suspending member, made of a transparent material, having a swelled portion printed with a pattern on its surface, many transparent air bubbles contained in said swelled portion, a connective head fixed on said swelled portion and provided with a light groove having a bottom just located on top of said swelled portion, said connective head inserted in said connect tube of said suspending member;

said LEDs of said light unit letting their light beams of different colors directly shoot through said swelled portion, said air bubbles in said swelled portion reflecting the light beams to provide the night-luminous decoration with shining effect of various colored lights.

2. The suspensible night-luminous decoration as claimed in claim 1, wherein said connect tube is provided with female threads.

3. The suspensible night-luminous decoration as claimed in claim 1, wherein said connective head of said decorative body is provided with male threads on its outer surface to engage said female threads of said connect tube of said suspending member, and said light groove of said connective head of said decorative body has its bottom located on top of said swelled portion.

* * * * *